United States Patent [19]

Rich et al.

[11] Patent Number: 4,580,914

[45] Date of Patent: Apr. 8, 1986

[54] APPARATUS AND METHOD FOR POSITIONING AN INK-JET PRINTING HEAD

[75] Inventors: Leonard G. Rich, West Hartford; Jeffrey J. Murray, Ellington; Brian Phelan, Cheshire, all of Conn.

[73] Assignee: Metromedia, Inc., Secaucus, N.J.

[21] Appl. No.: 637,161

[22] Filed: Aug. 2, 1984

[51] Int. Cl.[4] ..... B41J 11/20

[52] U.S. Cl. ..... 400/56; 400/126; 101/35

[58] Field of Search ..... 101/1, 35; 400/30, 123, 400/126, 56, 708

[56] References Cited

U.S. PATENT DOCUMENTS

| | | | |
|---|---|---|---|
| 3,606,162 | 9/1971 | Lehmann | 101/35 X |
| 3,867,882 | 2/1975 | Ahlgren et al. | 101/35 |
| 4,414,792 | 11/1983 | Bettencourt et al. | 56/10.2 |
| 4,479,433 | 10/1984 | MacPhee et al. | 101/364 |

FOREIGN PATENT DOCUMENTS

| | | | |
|---|---|---|---|
| 7413398 | 11/1975 | Fed. Rep. of Germany | 400/56 |
| 2608301 | 9/1977 | Fed. Rep. of Germany | 400/56 |
| 0059090 | 4/1983 | Japan | 400/56 |

OTHER PUBLICATIONS

IBM Technical Disclosure Bulletin, "Paper Edge Sensing", by Smith, vol. 20, No. 3, Aug. 1977, p. 904.

*Primary Examiner*—Edgar S. Burr
*Assistant Examiner*—John A. Weresh
*Attorney, Agent, or Firm*—McCormick, Paulding & Huber

[57] ABSTRACT

A circuit and related method are provided for maintaining a desired spacing between an ink-jet printing means and a receiving surface along a line scanned by the printing means. An ultrasonic transducer transmits signals at timed intervals to the receiving surface from the printing means. A reflected signal from the receiving surface is sensed by the transducer during a receiving time window after the signal is transmitted. A reference position signal representative of the head to surface spacing at a printing location is compared to the desired head to surface spacing to produce a position error signal. A servomotor responds to the position error signal to move the printing means toward and away from the receiving surface to maintain the desired spacing.

13 Claims, 16 Drawing Figures

APPARATUS AND METHOD FOR POSITIONING AN INK-JET PRINTING HEAD

BACKGROUND OF THE INVENTION

The present invention relates generally to ink-jet printing and deals more particularly with an ink-jet positioning apparatus or circuit and a related method for maintaining a desired spacing between an ink-jet printing means and a receiving surface.

Ink-jet printing devices such as, for example, non-impact matrix printers and the like, print alphanumeric characters, graphics or other such displays by generally ejecting ink drops or dots onto a receiving surface in accordance with control information provided to operate an ink-jet printing head. Generally, the receiving surface is held stationary against a back support or other means relative to the printing head to maintain a constant spacing between the head and the surface. As the printer head moves along a scan line it moves past a succession of points on the line in relation to each of which the printer head may eject an ink drop which lands on and prints a dot at that position. The flight of an ink drop in such ink-jet printing devices where a constant spacing is maintained between the ink-jet head and a receiving surface is at a fixed, uniform trajectory for each dot printed. Such ink-jet printing devices are commonly know in the art.

The recording medium forming the receiving surface used in such printing devices is generally of a uniform thickness and structurally undistorted so that there is no variation in the spacing between the ink-jet printing head and the surface along a line scanned by the head. Consequently, the ink-jet printing head in these devices can be positioned closely to the receiving surface and once positioned are able to maintain the desired spacing without additional adjustment during the printing process.

In some graphics display generating devices such as, for example, large scale sign generators for printing roadside billboards and the like, ink-jet printing techniques are used to produce a desired sign or other display. In one such large scale sign generator, panels used as the recording medium are placed in a side-to-side abutting relationship and pass in endless conveyor fashion by a dot printing mechanism which applies dots onto the face or receiving surface of the panels in a scanning fashion to produce the desired display. Often times the panels used as the recording medium are warped or have other structural distortions affecting the uniformity of the receiving surface. Such warped panels cause the spacing between the ink-jet printing head and the receiving surface to vary from a preset or desired spacing as the panels move by the dot applying station.

If the spacing increases placing the receiving surface too far from the printing head, the ejected ink drops start to drop before landing on the surface. Consequently, dots applied to a succession of points along a line on a warped receiving surface print a wavy or irregular line rather than a straight line. If the spacing becomes to small, the receiving surface is brought into contact with the printing mechanism causing damage to the ink-jet printing head. It would therefore be desireable to have a continuously variable positioning ink-jet printing head to compensate for movement of the receiving surface toward and away from the printing head to maintain a constant spacing between the receiving surface and the printing head at the printing location for each printing location.

It is therefore a general aim of the present invention to provide positioning apparatus for maintaining a desired spacing between an associated ink-jet printing head and a receiving surface at a printing location.

Other features and advantages of the present invention will become readily apparent from the following written description and the drawings forming a part thereof.

SUMMARY OF THE INVENTION

The present invention resides in positioning apparatus and a related method for maintaining a desired spacing between an ink-jet printing means and a receiving surface along a line scanned by the printing means. Means are provided for transmitting a signal at timed intervals to the receiving surface from the printing means. Other means are provided for sensing during a predetermined receiving time window a signal reflected from the receiving surface after transmitting the signal.

Means are also provided to produce a reference position signal representative of the desired spacing and other means are provided to produce a printing location position signal representative of the spacing at a printing location in response to the reflected signal sensing means. The printing location spacing is compared to the desired spacing by comparing means.

Means are provided for moving the printing means toward and away from the receiving surface in response to the comparing means to maintain the printing means to surface spacing at the desired spacing.

DETAILED DESCRIPTION

Figure 1:
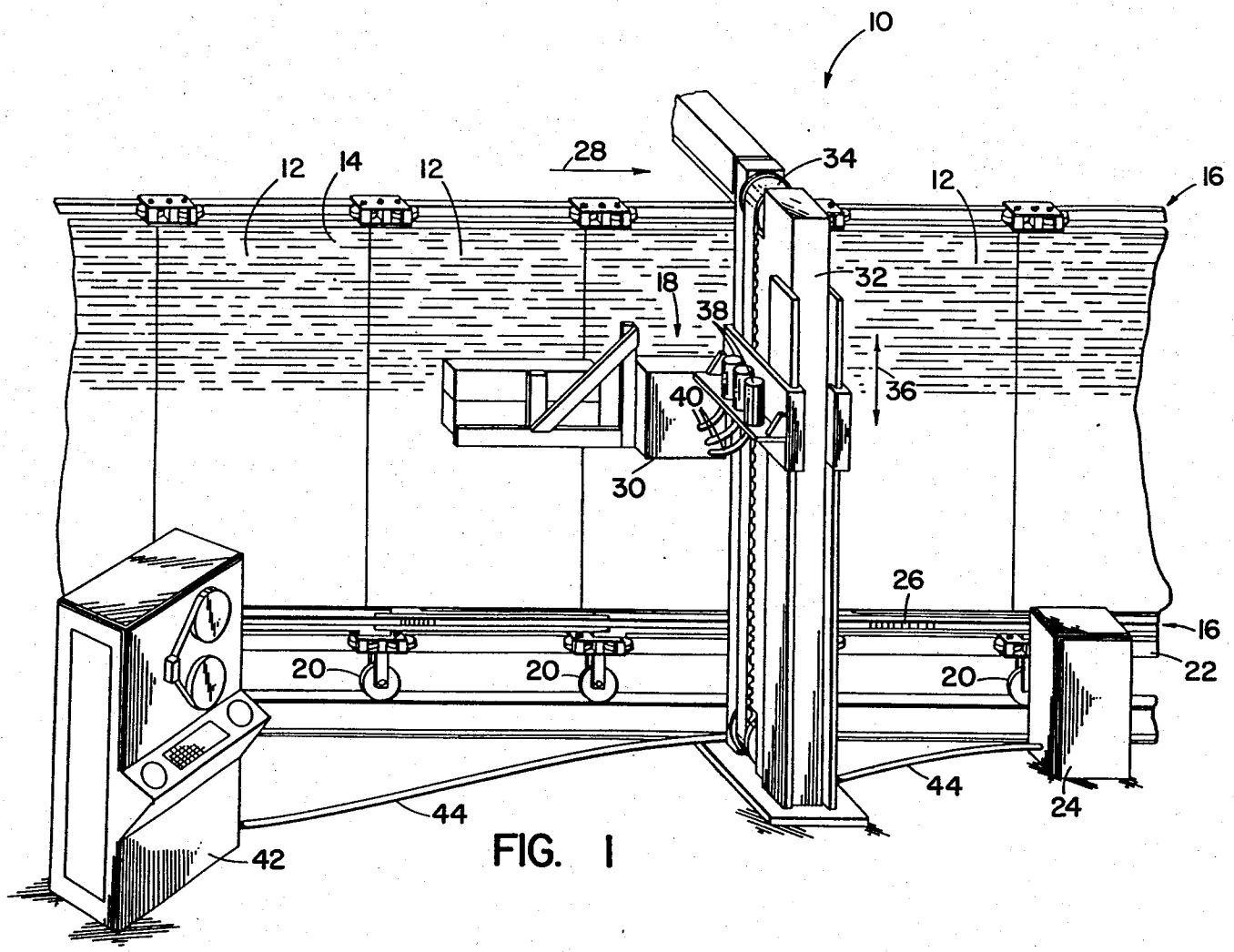
FIG. 1 shows a perspective view of a large scale sign generating system having apparatus embodying the present invention for positioning an ink-jet printing head relative to a receiving surface to maintain a desired spacing between the ink-jet head and the receiving surface.

Referring now to the drawings, the method and apparatus of the present invention are shown by way of example as embodied in a large scale sign generating system shown in perspective view in FIG. 1 and designated generally by the numeral 10. Briefly, panels 12, 12 collectively providing a receiving surface 14 are mounted on an endless conveyor designated generally at 16, for movement past a dot applying printing station 18. The conveyor 6 includes wheels 20, 20 which follow a guide track 22. A drive means 24 has a pinion gear (not shown) which engages a rack 26 on the conveyor 16 to drive it and the attached panels 12, 12 past the printing station 18 in the direction of the arrow 28.

At the printing station 18, color dot applicator means in the form of an ink-jet printing mechanism 30 embodying the present invention is disposed in front of the panels 12, 12 and is driven vertically along an upright supporting column 32 by a driving means 34, as indicated by arrow 36, perpendicular to the direction of movement of the panels. A supply of pigmented inks or other colored liquids is provided to the printing mechanism 30 from a number of reservoirs 38, 38 by associated conduits 40, 40.

A computer 42 controls the drive means 34, the drive means 24 and the printing mechanism 30 via a cable 44 and causes the printing mechanism 30 to apply colored dots to the receiving surface 14 to produce a desired color sign or other display.

Figure 2:
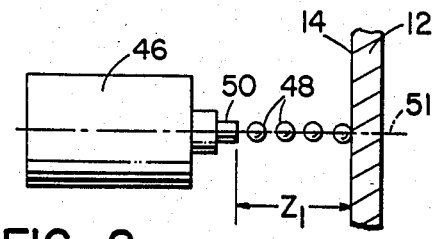
FIG. 2 is a schematic view showing the trajectory of ejected ink drops onto a receiving surface at a desired spacing between an ink-jet head and the receiving surface.
Figure 3:
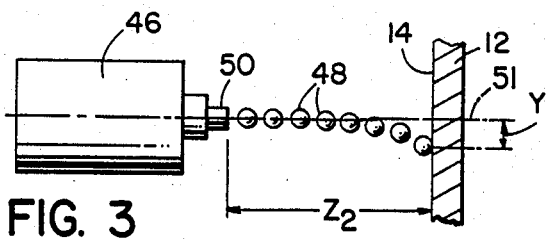
FIG. 3 is a schematic view showing the trajectory of ejected ink drops onto a receiving surface at a spacing between an ink-jet head and the receiving surface which causes the ink drops to drop before landing on the surface.

Referring now to FIGS. 2 and 3, an elevational schematic side view of an ink-jet head and section of a receiving surface panel are shown therein. In FIG. 2 an ink-jet head 46 and its associated nozzle 50 are shown at a spacing Z1 from the receiving surface 14 of a panel 12. The distance Z1 is such that ink drops 48, 48 ejected from the ink-jet nozzle 50 follow a straight line trajectory along a reference line 51 passing through the nozzle perpendicular to the receiving surface 14. Referring to FIG. 3, an ink-jet head 46 and its associated nozzle 50 are shown at a spacing Z2 from the receiving surface 14 of a panel 12. The spacing Z2 is greater than a maximum spacing beyond which a straight line trajectory cannot be maintained. The ejected ink drops 48, 48 having a greater distance to travel to the receiving surface 14 follow a dropping trajectory such that dots are applied to printing locations at a distance Y below the reference line 51 passing through the nozzle 50. As the spacing between the head 46 and the surface 14 increases, the printing location on the receiving surface 14 becomes lower increasing the distance Y.

In the head to surface spacing shown in both FIGS. 2 and 3, a straight line is printed as the printing head 46 moves in a scanning relationship with the surface 14 and either head to surface spacing or other spacings can be used to generate the desired graphic display. However, changes in the spacing between the ink-jet head 46 and the receiving surface 14 from a preset spacing as the head scans across the surface causes ejected ink drops to be applied at undesired printing locations on the surface and produces a distorted or wavy line as explained in more detail below.

Figure 4:
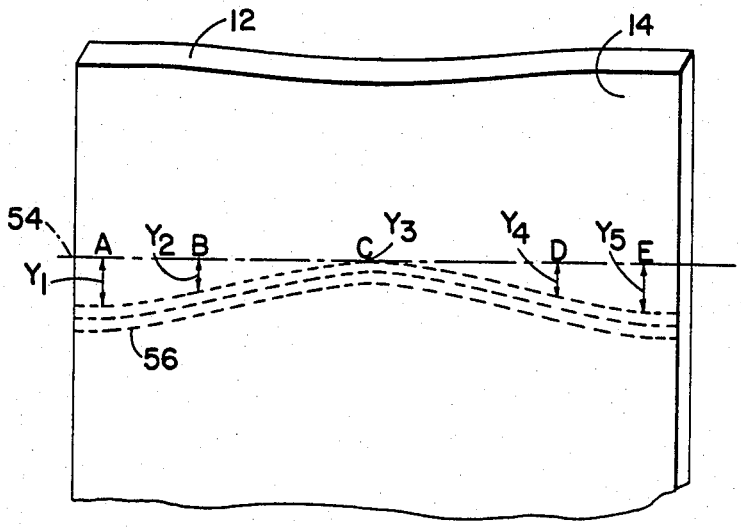
FIG. 4 is a perspective view showing a panel of the type used as the receiving surface in the sign generating system of FIG. 1 in which the panel shown is warped.
Figure 5:
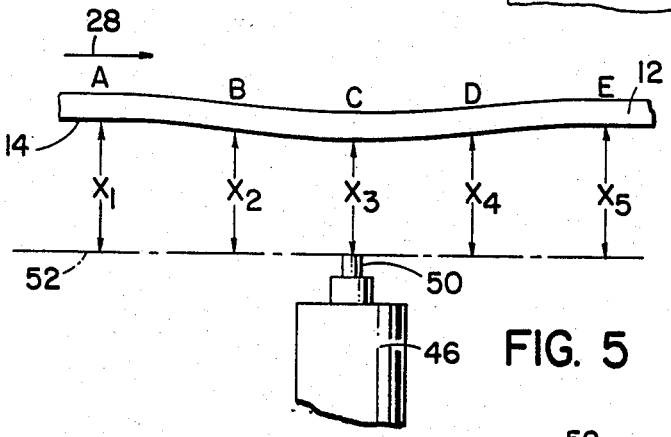
FIG. 5 is a schematic top plan view of the panel of FIG. 4 and an ink-jet printing head illustrating spacing variations at locations along one scan line on the receiving surface with reference to a line passing throught the ink-jet head.

Referring now to FIGS. 4 and 5, FIG. 4 is a perspective view showing a panel of the type used to form the receiving surface in the sign generating system of FIG. 1. The panel of FIG. 4 is shown with a structural distortion or warpage. FIG. 5 shows a schematic top plan view of the panel of FIG. 4 and an ink-jet printing head 46 illustrating spacing variations at locations along one scanned line on the receiving surface 14 with respect to a reference line 52 passing through the ink-jet nozzle 50 parallel to the direction of movement of the panel 12 as shown by the direction arrow 28. For purposes of explanation and by way of example, a scanned line 54 is printed on the receiving surface 14 and has selected printing locations designated at A, B, C, D and E and correspond to like lettered printing locations shown in FIG. 5. For example, when the ink-jet printing head 46 is set at a spacing X3 at printing location C as shown in FIG. 5, a corresponding dot is printed at the printing location C on the receiving surface 14 at the desired location along the scan line 54 as shown in FIG. 4. Line 54 is shown as it appears on the receiving surface 14 when printed by an ink-jet head having a constant spacing for example, X3, from the surface.

Line 56 is shown in FIG. 4 as it appears on the receiving surface 14 of the warped panel 12 when ink drops are ejected onto the surface from an ink-jet printing head 46 having a fixed mounting position. As the head 46 moves in a scanning relationship with the surface 14, the spacing between the printing head and the receiving surface varies as the panel moves toward and away from the printing head due to the panel distortion. Line 56 as shown is printed by ink drops ejected from the printing head 46 and has at selected printing locations A, B, C, D and E head to surface spacings of X1, X2, X3, X4 and X5, respectively from the reference line 52. Because the ink drops have a greater distance to travel at printing locations A, B, D and E compared to the distance at location C, the trajectory is such that an ink drop lands on the receiving surface at distances Y1, Y2, Y4 and Y5 below the scanned line 54 for printing locations A, B, D and E respectively. Thus it can be seen that a wavy or irregular line is printed on the surface of a warped panel due to spacing variations between the printing head 46 and the receiving surface 14 as the printing head moves in a scanning relationship with the surface.

Figure 6:
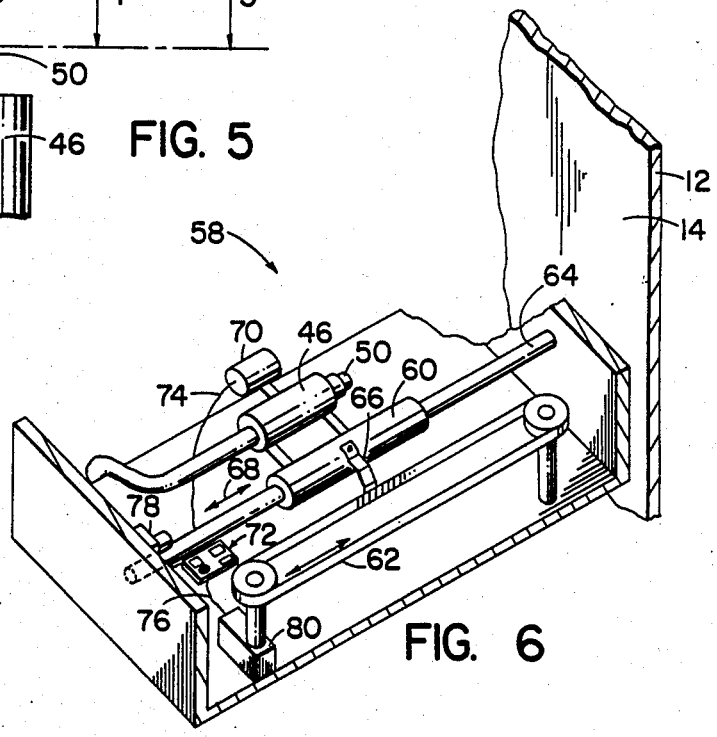
FIG. 6 is a perspective view showing an ink-jet printing head positioning apparatus embodying the present invention.

Referring now to FIG. 6, an ink-jet head positioning apparatus embodying the present invention is shown in perspective view and is designated generally by the numeral 58. An ink-jet head 46 is attached to a moveable mounting member 60 which is driven along a guide means 64 in the direction of arrow 68 by a drive means 62 coupled to the mounting member by a bracket 66. An ultrasonic transducer means 70 is coupled to and moves with the ink-jet printing head 46 and mounting member 60. The transducer 70 and printing head 46 are arranged in a side-by-side relationship so that a printing location on the receiving surface 14 passes the transducer for sensing and adjustment of, if necessary, the head to surface spacing prior to printing at the location.

An electrical circuit designated generally at 72 controls the operation of the transducer 70 through a cable 74. As explained in greater detail below, a transmitting portion of the circuit 72 causes transducer 70 to transmit ultrasonic signals to the receiving surface 14 at timed intervals. The transducer 70 is also connected to a receiving portion of the circuit 72 which is enabled to amplify sensed reflected signals or echos from the surface 14 received within a predetermined time interval or receiving time window between successive transmissions. The spacing between the printing head 46 and the receiving surface 14 is related to the time interval between transmission to and receiving the signal reflected from the surface.

A positioning signal for driving a servomotor 80 is produced by comparing a reference position signal representative of the time interval between transmission and return at the desired head to surface spacing to a printing location position signal representative of the time interval between transmission and return at the printing location head to surface spacing. The ink-jet printing head 46 is spaced relative to the receiving surface 14 for each printing location in accordance with the positioning signal coupled from the circuit 72 to the servomotor 80 via a cable 76.

A limit switch 78 is mechanically actuated by the mounting member 60 to disconnect driving voltage of one polarity from the servomotor 80 when the time interval between transmission and sensing of the reflected signal is such to produce a positioning signal that, if not interrupted, retracts the transducer 70 away from the surface 14 and out of its operating range. Such a positioning signal is generated, for example, when the spacing between the printing head 46 and the surface 14 is greater than a predetermined distance such as at a gap between two abutting panels. The switch 78 is returned to its normally closed position when the time interval between transmission and sensing of the reflected signal is within the proper range to produce a positioning signal of the opposite polarity to operate the servomotor 80 to move the head 46 and transducer 70 toward the surface.

Figure 7:
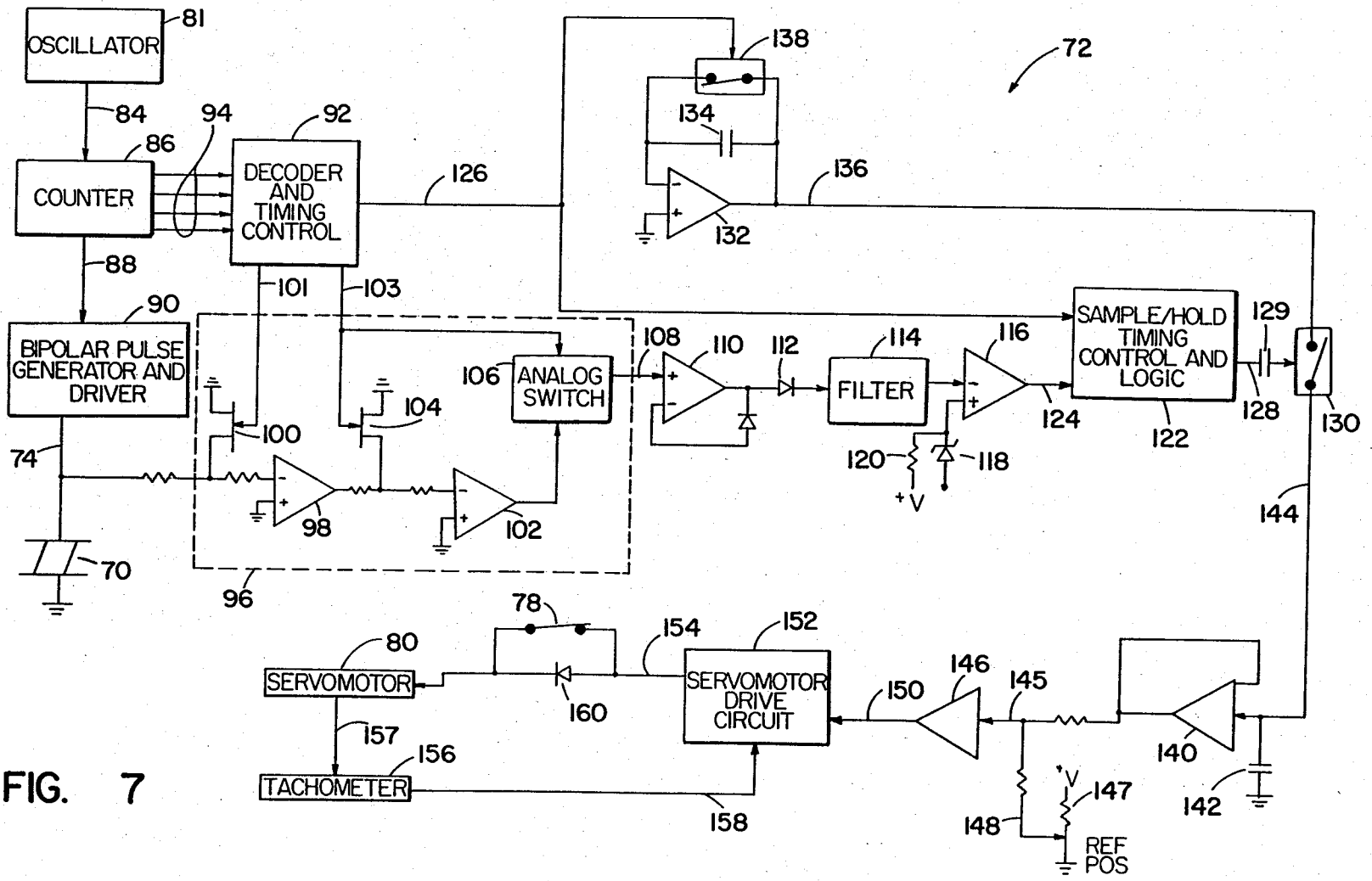
FIG. 7 is a functional block diagram partially in schematic form of an ink-jet head positioning circuit embodying the present invention.
Figure 8:
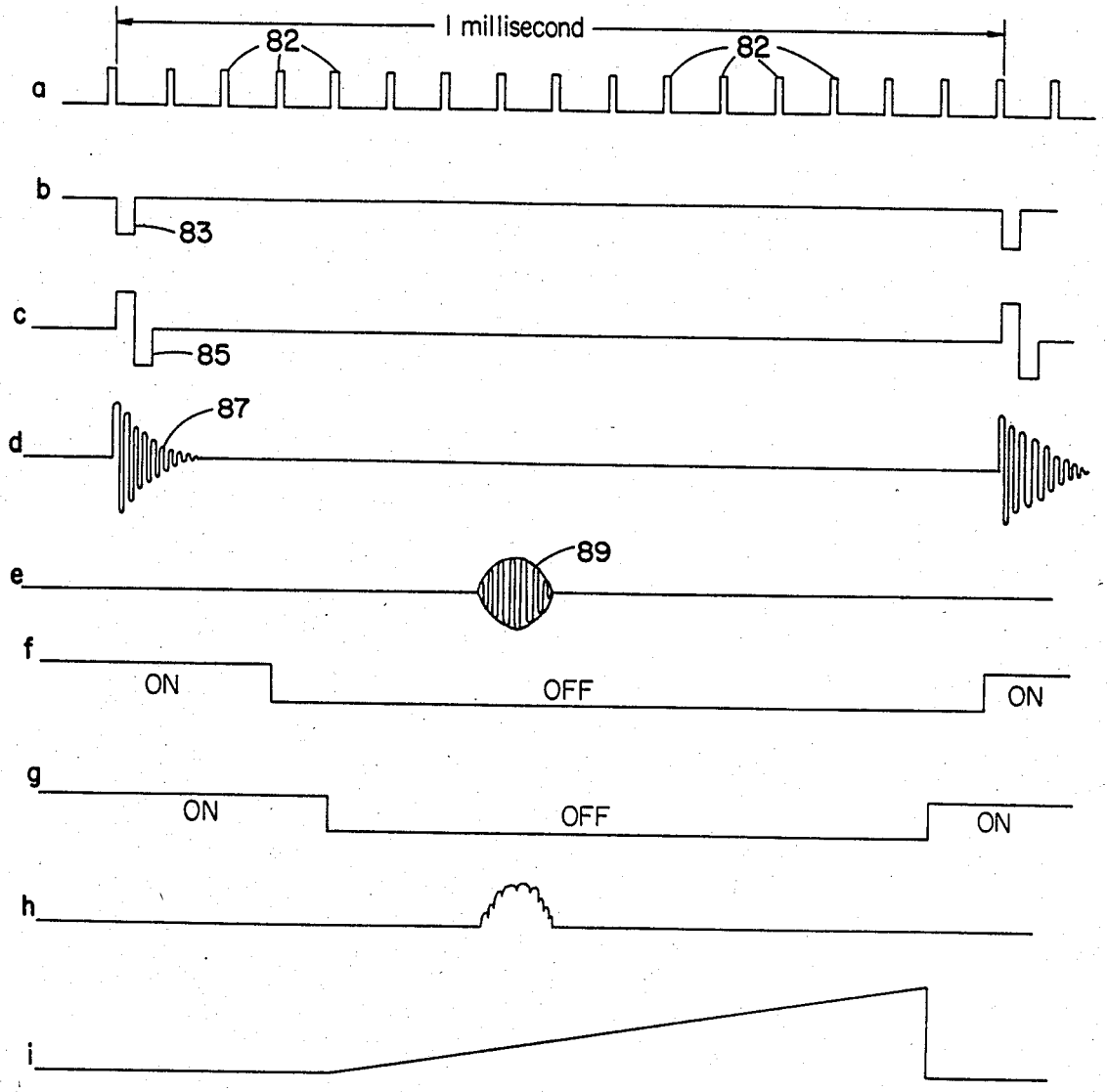
FIGS. 8*a*–8*i* show timing and voltage waveforms at various locations in the circuit of FIG. 7.

Considering now the electrical circuit of the present invention in more detail and referring to FIGS. 7 and 8, a functional block diagram partially in schematic form of the ink-jet head positioning circuit is shown in FIG. 7 and is designated generally by the number 72. FIGS. 8*a*–8*i* show representative voltage waveforms at various points in the circuit of FIG. 7. An oscillator designated generally at 81 generates pulses 82, 82 shown in FIG. 8*a* at a frequency of 16 kilohertz. The pulses 82, 82 are two microseconds in duration and are fed via lead 84 to a counter 86. The counter 86 is a 16 count binary up counter and generates a carrier out pulse 83 shown in FIG. 8*b* on lead 88 each time the count reaches 16 or once every millisecond. The carrier out pulse 83 is fed to a bipolar pulse generator and driver circuit designated at 90 which circuit generates a bipolar pulse 85 shown in FIG. 8*c* having a positive and negative pulse width of 2.3 microseconds. The bipolar pulse 85 drives transducer 70 via lead 74 once every millisecond to cause the transducer to transmit an ultrasonic signal 87 shown in FIG. 8*d* at its resonant frequency to the receiving surface.

The output of counter 86 is fed to a decoder and timing control circuit designated at 92 via leads 94. The decoder 92 is a 4 to 1 of 16 decoder coupled to set/reset timing logic to generate timing pulses and enabling signals in the circuit 72 as explained below.

A reflected signal or echo 89 shown in FIG. 8*e* is sensed by the transducer 70 and is coupled via lead 74 to a receiving portion of the circuitry 72 designated generally within the dotted line enclosure 96. The receiving circuit 96 is enabled for a predetermined interval between successive transmissions to receive and amplify a sensed reflected signal. Reflected signals appearing at the transducer 70 outside the receiving window are not sensed and the ink-jet head is retracted as mentioned above until a reflected signal is sensed within the receiving window. A reflected signal arrives at the transducer 70 prior to the window opening when the printing head to surface spacing is smaller than a predetermined spacing. A reflected signal arrives at the transducer 70 after the window is closed when the printing head to surface spacing is greater than a predetermined spacing. Reflected signals arrive at the transducer within the window when the printing head to surface spacing is within a desired spacing range and corresponds in the present invention to a transducer to surface spacing in the range of three to five inches.

The input of a high gain amplifier 98 is connected to the transducer 70 via lead 74 and to ground through an FET 100. The gate of FET 100 is connected to the decoder and timing control circuit 92 via lead 101. The FET 100 holds the input to amplifier 98 at ground potential until it is turned OFF by the decoder and timing control circuit 92 on the third count after a signal has been transmitted by the ultrasonic transducer 70. The FET 100 is turned ON again on the sixteenth count. The ON and OFF voltage signals for FET 100 are shown in FIG. 8*f*. The reflected signal, if present between the third and sixteenth count, is amplified by amplifier 98 and is coupled to an input of a second high gain amplifier 102.

The input to amplifier 102 is also shunted to ground by an FET 104 which is controlled by and connected via lead 103 to the decoder and timing control circuit 92. The FET 104 holds the input to amplifier 102 at ground potential until it is turned OFF on the fourth count after a signal is transmitted by transducer 70. The FET 104 is turned ON again on the fifteenth count. The ON and OFF voltage signals for FET 104 are shown in FIG. 8*g*. Amplifier 102 further amplifies the reflected signal between the fourth and fifteen the count and its output is connected to an analog switch 106.

The analog switch 106 is connected to the decoder and timing control circuit 92 via lead 103 and couples the signal from amplifier 102 to the input of a halfwave rectifier via lead 108 during the same time interval that FET 104 is OFF. The halfwave rectifier is made up of amplifier 110 and diode 112. The halfwave rectified signal is filtered by a filter 114 to remove the transducer resonant frequency from the halfwave rectified signal. The output of the filter 114 shown in FIG. 8*h* is fed to the input of an edge triggered detector 116 which produces an output pulse when the voltage at its inverting terminal exceeds a triggering voltage reference level established by the combination of zener diode 118 and resistor 120.

The output of detector 116 is fed via lead 124 to a sample and hold timing control logic circuit designated generally at 122. The sample and hold logic circuit 122 contains set/reset circuitry to generate a signal on lead 128 which is coupled through capacitor 129 to an electronic switch 130. A reset voltage signal coincidental with the time FET 104 is OFF, is generated by the decoder and timing circuit on lead 126 to reset the sample and hold logic circuit 122 to generate an output pulse on lead 128 each time a reflected signal is received and detected within the receiving window.

The electronic switch 130 is a normally open switch and operates momentarily each time a pulse is generated on lead 128. The momentary operation is caused by the capacitive coupling from the logic circuit 122 output to the switch input.

A ramp generator comprised of amplifier 132 and capacitor 134 is a time to voltage converter and generates a ramp voltage at the output of amplifier 132 which is connected to one side of the electronic switch 130 by lead 136. The charging and discharging of capacitor 134 is controlled by a normally closed electronic switch 138 connected in parallel with the capacitor. The switch 138 is operated to its open condition allowing capacitor 134 to charge during the time that the reset voltage is present on lead 126 to produce the ramp voltage as shown by the waveform in FIG. 8*i*. Capacitor 134 discharges when switch 138 is returned to its closed condition. The magnitude of the ramp voltage at any point along the ramp is proportional to the time a reflected signal is sensed by the transducer 70 after a transmission.

The input of a sample and hold circuit comprised of amplifier 140 and a holding capacitor 142 is connected to the other side of electronic switch 130 by lead 144. The holding capacitor 142 is charged to the ramp generator output voltage each time switch 130 is operated to its closed condition. The sample and hold amplifier 140 is configured as a voltage follower and its output on lead 145 is a voltage signal following the magnitude of the voltage across the holding capacitor. Consequently, the output voltage signal has a magnitude representative of the position of the transducer 70 and accordingly the spacing between the transducer 70 and the receiving surface 14.

If reflected signals are not sensed within the receiving window, electronic switch 130 does not complete the charging path for holding capacitor 142 and the voltage across the capacitor decays to zero thereby causing the output of amplifier 140 to fall to zero.

The position signal is fed to the input of a positioning amplifier 146 which compares the voltage of the position signal to a reference voltage representative of a desired spacing between the printing head 46 and the receiving surface 14. The output of amplifier 146 is a position error voltage signal on lead 150 and is coupled to a servomotor drive circuit 152. The drive circuit 152 provides a negative or positive polarity driving voltage on lead 154 through the limit switch 78 to power servomotor 80.

When switch 78 operates as described above, the negative polarity driving voltage causing the servomotor 80 to retract the printing head 46 and transducer 70 is removed. The servomotor 80 will now only operate with a positive driving voltage being applied through a diode 160 which blocks negative driving voltages. A positive voltage causes servomotor 80 to move the head and transducer toward the receiving surface causing switch 78 to release to its closed position.

The reference position voltage level is set by adjusting potentiometer 147 to provide a voltage on lead 148 which when fed to the input of amplifier 146 causes a zero position error voltage to be produced at the output of amplifier 146 when the spacing between the printing head 46 and the receiving surface 14 is at the desired spacing.

The servomotor 80 is connected to a tachometer 156 via lead 157 to provide a velocity feedback voltage signal on lead 158 to the servomotor drive circuit 152. The position error signal on lead 150 and the velocity feedback signal on 158 are summed in accordance with well know closed loop servo system concepts to drive the servomotor and accordingly maintain the desired spacing between the ink-jet head 46 and receiving surface 14.

An ink-jet head positioning apparatus has been described in one preferred embodiment; however, numerous modifications and changes may be had without departing from the spirit of the invention. Therefore, the invention has been described by way of illustration rather than of limitation.

We claim:

1. Positioning apparatus for maintaining a desired spacing between an ink jet printing means and a receiving surface along a line scanned by the printing means, said apparatus comprising:

means for transmitting one and only one signal at a time at timed intervals from the printing means directly to the receiving surface at the printing location;

means for providing one and only one receiving time interval between successive transmissions of said signal;

means for sensing during said receiving time interval, and for a substantially instantaneous period of time, said signal reflected directly from the receiving surface;

means responsive to said reflected signal sensing means for producing a reference position signal representative of the desired spacing;

means responsive to said reflected signal sensing means for producing a printing location position signal representative of the spacing at a printing location;

means for comparing the printing location spacing and the desired spacing, and means for moving the printing means toward and away from the receiving surface in response to said comparing means without physical contact between the sensing means and the receiving surface to maintain the desired spacing between the printing means and the receiving surface at the printing location.

2. Positioning apparatus as defined in claim 1 further characterized by said transmitting means and said sensing means including an ultrasonic transducer.

3. Positioning apparatus as defined in claim 2 further characterized by said apparatus including:

a source of pulses;

means for counting pulses, and means for generating a driving pulse at a predetermined pulse count to cause said ultrasonic transducer to transmit said signal.

4. Positioning apparatus as defined in claim 3 further characterized by said sensing means including circuitry means for receiving and amplifying said reflected signal sensed by said transducer, said circuitry means being enabled during one and only one predetermined receiving time window between successive transmissions.

5. Positioning apparatus as defined in claim 4 further characterized by said receiving time window opening on the fourth count and closing on the fifteenth count after a signal is transmitted by said transducer.

6. Positioning apparatus as defined in claim 4 further characterized by said sensing means including:

means for detecting a reflected signal received within the receiving time window;

means for generating a linear time base voltage signal, said time base signal starting with the beginning of and ending with the end of the receiving time window, and means for sensing the time base voltage signal at the time said reflected signal is detected, said time base voltage magnitude being representative of the spacing between the printing means and the receiving surface.

7. Positioning apparatus as defined in claim 6 further characterized by said means for producing a printing location position signal including:

sample and hold circuitry means coupled to said sensing means and having a holding capacitor connected to its input;

means for transferring between successive transmissions said sensed time base voltage to said holding capacitor, and said sample and hold circuitry means having an output signal following the voltage across said holding capacitor, said output signal being representative of the printing means to surface spacing at the printing location.

8. Positioning apparatus as defined in claim 7 further characterized by said comparing means producing a position error voltage signal, said error signal being representative of the difference in spacing between the desired spacing and the printing location spacing, and said error signal further having a polarity, one polarity signal indicating that the spacing is less than the desired spacing and the other polarity indicating the spacing is greater than the desired spacing.

9. Positioning apparatus as defined in claim 8 further characterized by said time base voltage signal not being transferred when said reflected signal is sensed by said transducer during a time interval outside said receiving time window, said holding capacitor voltage decaying to zero thereby producing a position error voltage signal having a magnitude and polarity to increase the printing means to surface spacing.

10. Positioning apparatus as defined in claim 9 further characterized by said moving means including a servomotor.

11. Method for maintaining a desired spacing between an ink jet printing means and a receiving surface along a line scanned by the printing means comprising the steps of:

transmitting one and only one signal at a time at timed intervals from the printing means directly to the receiving surface at the printing location;

providing one and only one receiving time interval between successive transmissions of said signal;

sensing during said receiving time interval, and for a substantially instananeous period of time, said signal reflected directly from the receiving surface;

setting the spacing between the ink jet printing means and the receiving surface to a desired spacing;

producing a reference position signal representative of the desired spacing;

producing a printing location position signal representative of the spacing at a printing location;

comparing the printing location spacing and the desired spacing, and moving the printing means toward and away from the receiving surface in response to said comparing means without physical contact between the sensing means and the receiving surface to maintain the desired spacing between the printing means and the receiving surface at the printing location.

12. The method of claim 11 further characterized by the steps of:

transmitting an ultrasonic signal from the ink jet printing means directly to the receiving surface, and sensing said ultrasonic signal during said receiving time interval.

13. The method of claim 11 further characterized by the step of retracting the printing means away from the receiving surface in response to the absence of sensing said signal during said receiving time interval.

* * * * *